US006209664B1

(12) United States Patent
Amaudric du Chaffaut

(10) Patent No.: US 6,209,664 B1
(45) Date of Patent: Apr. 3, 2001

(54) DEVICE AND METHOD FOR CONTROLLING THE TRAJECTORY OF A WELLBORE

(75) Inventor: Benoît Amaudric du Chaffaut, Voisin le Bretonneux (FR)

(73) Assignee: Francis du Petrole, Rueil-Malmaison (FR)

( * ) Notice: Subject to any disclaimer, the term of this patent is extended or adjusted under 35 U.S.C. 154(b) by 0 days.

(21) Appl. No.: 09/343,218

(22) Filed: Jun. 30, 1999

(30) Foreign Application Priority Data

Jul. 3, 1998 (FR) ..... 98 08589

(51) Int. Cl.[7] ..... E21B 7/04
(52) U.S. Cl. ..... 175/61
(58) Field of Search ..... 175/61, 73, 74, 175/75, 76, 267, 45, 62, 326, 325.3, 325.4

(56) References Cited

U.S. PATENT DOCUMENTS 5,060,736 * 10/1991 Neff ..... 175/74
5,467,832 * 11/1995 Orban et al. ..... 175/45
5,603,386 * 2/1997 Webster ..... 175/76
5,836,406 * 11/1998 Schuh ..... 175/61
5,931,239 * 8/1999 Schuh ..... 175/61

* cited by examiner

*Primary Examiner*—Robert E. Pezzuto
(74) *Attorney, Agent, or Firm*—Antonelli, Terry, Stout, Kraus, LLP

(57) ABSTRACT

The present invention is a device for controlling the direction of the trajectory of a wellbore, comprising a shaft (1) driven in rotation, a drill bit (11) secured to the shaft, a substantially cylindrical body (2) coaxial with the shaft and freely rotating in relation to the shaft pads (3) carried by the body that can move radially, and a pad displacement mechanism (96). The displacement mechanism individually comprises, for each pad, at least one thruster (7) whose longitudinal displacement in relation to the axis of the device causes an extension of the pad. Actuators (9) are driven by hydraulic energy supplied by drilling fluid circulating in the shaft and comprise a system (8) for selecting radical displacement of less than all of the pads.

28 Claims, 4 Drawing Sheets

DEVICE AND METHOD FOR CONTROLLING THE TRAJECTORY OF A WELLBORE

BACKGROUND OF THE INVENTION

1. Field of the Invention

The present invention relates to a device for controlling the trajectory of a well drilled in the ground.

2. Description of the Prior Art

There are many well-known systems allowing control of the well inclination, for example by using a remote-controlled variable-diameter stabilizer. For azimuth correction, a downhole motor included in the drill string and coupled with a bent sub, whose direction correction action is done according to the spatial orientation in the plane of the bent sub, has been used in the trade for a long time. It is clear that, with this technique, the part of the string situated above the motor must be motionless in the borehole. This correction mode is referred to as <sliding> mode insofar as drilling progresses by <sliding>. This mode has many drawbacks, notably the fact that all of the drill string is not driven in rotation.

Directional drilling means that can work in a rotary mode have therefore been developed. Among the tools proposed, some exert a permanent or periodic controlled lateral stress on the wall of the well, in an opposite direction to the desired one, others exert an oriented flexion on the part of the pipes situated immediately above the tool, while allowing them to rotate. In any case, the necessity of maintaining the pipes rotating combined with that of controlling a fixed spatial orientation leads to sophisticated and expensive mechanical, hydraulic and electronic options.

SUMMARY OF THE INVENTION

The present invention thus relates to a device for controlling the direction of the trajectory of a wellbore, comprising a shaft driven in rotation, a drill bit secured to the shaft, a substantially cylindrical body coaxial with the shaft and freely rotating in relation to the shaft, one or more pads carried by the body that can move radially, and pad displacement mechanisms. In the device, the displacement mechanisms individually comprise, for each pad, at least one thruster whose longitudinal displacement in relation to the axis of the device causes extension of the pad. The thruster is displaced by an activation system driven by the hydraulic energy supplied by the drilling fluid circulating in the shaft and the actuator comprises a system for selecting the absence of displacement of at least one pad while the others, if any, are displaced.

In particular, the invention can be applied to oil production wells whose position in geologic reservoir beds must be defined relatively precisely. The inclination of the wellbore to the vertical and its azimuth therefore have to be controlled.

The body can comprise means for orientation the body by rotation about the axis of the shaft.

The means for orienting the body can comprise a ballast fastened along a generatrix of the body.

The activation system can comprise an annular piston that moves longitudinally in the body under the effect of the differential pressure between the inner space of the shaft and the inside of the well.

The annular piston can longitudinally displace a cylindrical barrel-shaped part comprising a slot in the direction of a generatrix of the cylinder, the width and the length of the slot corresponding to the shape of at least one thruster of a pad.

The slot can be oriented in relation to the well by adjustment of the body.

The selection system can comprise a series of grooves and at least one finger connected to the body.

The series of grooves can be carried by the barrel the slot of the barrel being oriented in relation to the body by cooperation of the finger and of the series of grooves.

In the device, in the absence of flow of drilling fluid, the series of grooves can be such that the barrel always has the same position in relation to the body.

The invention also relates to a method for controlling the trajectory of a weilbore in which the following stages are carried out:

- the device described above is placed at the end of drillpipes,
- the drill bit is driven in rotation by rotation of the shaft of the device and a drilling fluid is injected at a flow rate Df,
- circulation sequences are carried out between a zero flow rate and a flow rate Da lower than Df, so as to orient the barrel in the body of the device and to actuate at least one pad when the flow rate is Df.

In the present method, the direction of the trajectory can be measured and the orientation of the barrel can be modified if the trajectory is not correct.

The present device fulfils either a centering function or a deviation function, according to its configuration, and it is actuated and controlled mainly by the flow of the drilling fluid. This tool is thus compatible with the equipments and procedures commonly used in drilling.

BRIEF DESCRIPTION OF THE DRAWINGS

Other features and advantages of the invention will be clear from reading the description of the non limitative example hereafter, with reference to the accompanying drawings wherein.

DETAILED DESCRIPTION OF THE INVENTION

Figure 1:
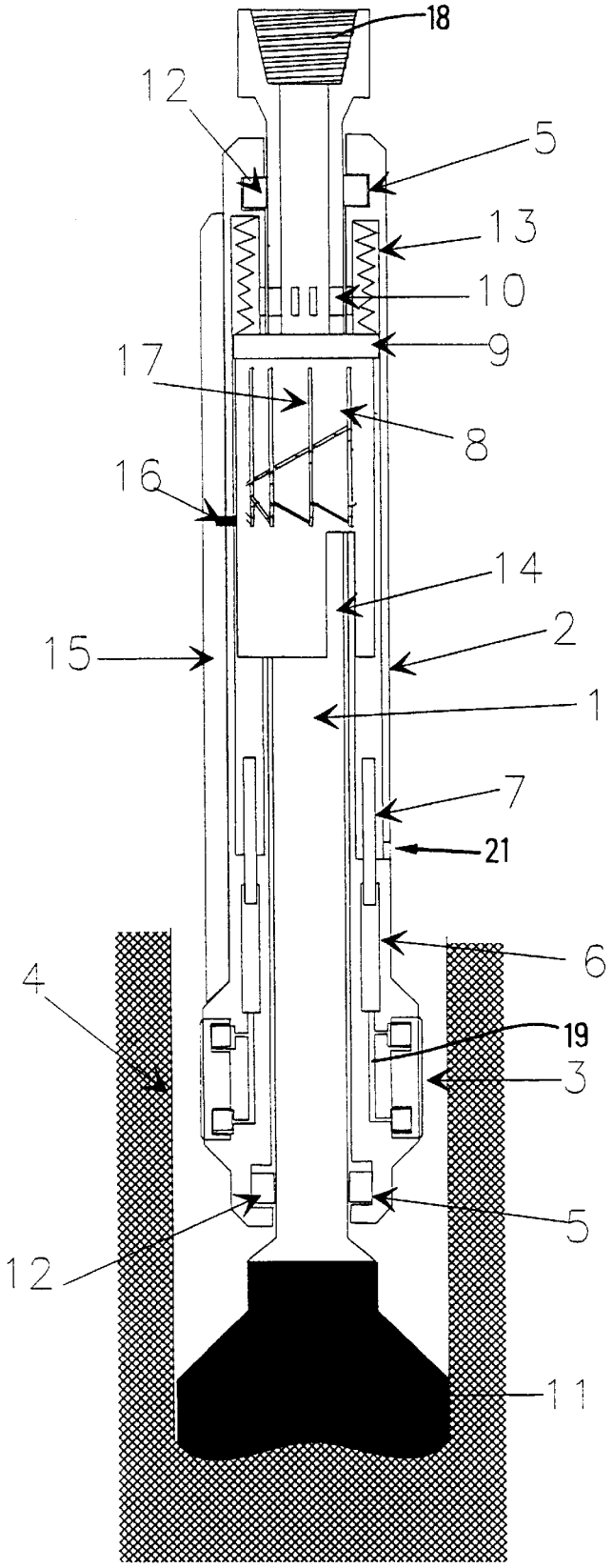
FIG. 1 shows, in lengthwise section, a diagram of the device.

A shaft 1 is connected to the base of the drill string (not shown) by connection 18. This shaft carries a drill bit 11 at its lower end. Shaft 1 rotates in a tubular shell 2 equipped with a certain number of pads 3 evenly distributed on its circumference. These pads can be spread to come into contact with the wall of well 4 and to exert there a radial deviation stress. Shell or body 2 acts as a rotation bearing for shaft 1 by means of needle, roller or ball bearings 5. Body 2 also acts as an active guide in the deviated hole, considering the orientation of the pads resting on the wall of the well.

Each one of pads 3 is actuated by an independent mechanical or hydraulic system This independent system can be, for example, a hydraulic circuit comprising a cylinder 6 in which a piston 7 can move and discharge oil through line 19 towards pistons 20 acting as thrusters for pad 3. The pad actuation system can also comprise a mechanical thruster/rod or thruster/cam type unit, or any other suitable system for converting a longitudinal stress or displacement parallel to the axis of the device into a radial stress or displacement allowing the pad to spread up to the wall of the wellbore and to press on this wall with a sufficient stress to change the trajectory of the borehole. In the absence of activation of the pad actuation system, a return device such as springs (not shown) keep each pad retracted and therefore without any contact with the wall of the well.

The displacement or the stress parallel to the axis of the device required for displacement of pistons 7 is provided by a tubular barrel-shaped part 8, itself driven by an annular jack 9 driven by the pressure difference between the inside of the drill string (pipes) and the annular space situated between the field and the pipes. The inside pressure of the pipes is transmitted to the upper face of the annular jack through openings 10 provided in the central rotating part 1 of the device and through other openings in the opposite non-rotating part. Orifice 21 provides communication between the space containing barrel 8 and the outer space. Piston 9 thus comprises seals (not shown) between the inside of piston 9 and shaft 1, and between the outside of piston 9 and body 2, as it is known in the trade. This pressure difference is typically obtained by the forced circulation of the drilling fluid from the inside of the pipes to the outside, through drill bit 11 situated at the end of shaft 1 and provided with nozzles. This internal pressure is maintained during the rotation of the drill string by means of rotor seals 12. In the absence of fluid circulation, the jack and the barrel are kept in a resting position by one or more return springs 13 acting the opposite way from the aforementioned pressure difference. In the diagram of FIG. 1, spring 13 is stretched when the barrel is displaced by the pressure and it shortens in return through the absence of pressure. Of course, any other layout, using a compressive stress for example, can be used. The complete travel of the barrel is obtained through the stress corresponding to a drilling fluid flow rate less than or equal to the nominal drilling flow rate. It will thus be possible to perform a partial travel by means of a partial drilling fluid flow rate, the position of the unit made up of jack 9 and barrel 8 will then result from the balance between the force generated by the pressure difference acting on the jack and the force of return spring(s) 13.

Tubular barrel 8 has a particular profile at its lower end, such as for example a notch 14 whose depth prevent actuating one of the pads. In fact, piston(s) 7 situated opposite this notch are not displaced when the barrel is pushed by the pressure of the fluid. The pad(s) corresponding to this or these piston(s) 7 will thus remain retracted whereas the others will be spread to exert a radial stress on the wall of the well. In the (preferred) case of an embodiment with four pads, the device spreads three pads so as to exert three contacts or stresses on the wall of the well: two opposite stresses that will provide centering in a plane and one perpendicular to this plane. The direction of the trajectory deviation is in the direction of the retracted pad. The profile of the lower end of the barrel, i.e. the width of notch 14, can also be selected to actuate a single pad or group of pads in a selected direction.

Selection of the pad not to be spread requires previous location of this pad or group of pads and correct orientation of the barrel in relation to the axis of the well, before the barrel performs its longitudinal motion in order to displace the pads.

Orientation of the pads in relation to the vertical is achieved by means of a sufficient ballast 15 arranged for example along a generatrix of the outer shell and running on from one of pads 3. When circulation of the drilling fluid is stopped, all the pads are folded by means of their return systems. The assembly consisting of barrel 8 and annular jack 9 is in a resting position by means of spring return system 13. In the case where the well is inclined, thanks to the gravity force, the ballast goes into a lowered position in relation to the borehole. The friction of the seals and of the roller bearings must be sufficiently reduced to allow rotation of body 2 about shaft 1 under the action of the ballast. Two pads are thus oriented in a vertical plane and the two others in an inclined plane perpendicular to this vertical plane.

The pads being thus positioned in relation to the vertical, the position of the barrel in relation to body 2 is obtained for example by means of one or more fingers 16, fixed in relation to the outside body and engaged in slots 17 milled at the surface of this barrel. These fingers 16 are mounted in bores radial to body 2 on springs so as to be telescopic and to follow the variable depth of the grooves. The pattern and the depth of the grooves are such that a cycle of partial flows and drilling fluid circulation stops causes the barrel to rotate to a predetermined position in relation to the piston-shaped actuators 7 of pads 3. After orientation, the planned nominal drilling rate is then reached and causes complete travel of the barrel that actuates the desired pads in the required directions.

Orientation of the pads can also be achieved by means of electronic location in relation to the lower generatrix of the well and of a mechanical link system allowing connection with the drill string, that is then used from the surface to rotate the body. Location information can be transmitted to the surface by a conventional MWD (Measurement While Drilling) system.

FIGS. 2A to 2F are sectional views of the various adjustments of the device according to the position of the barrel.

Figure 2A:
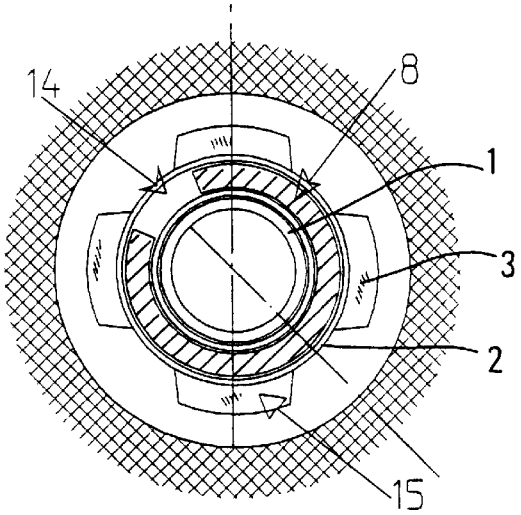
FIGS. 2A, 2B, 2C, 2D, 2E and 2F show several cross-sections according to the adjustment of the device, FIGS. 3 and 4 diagrammatically show an example of means for selecting a determined position.
Figure 2B:
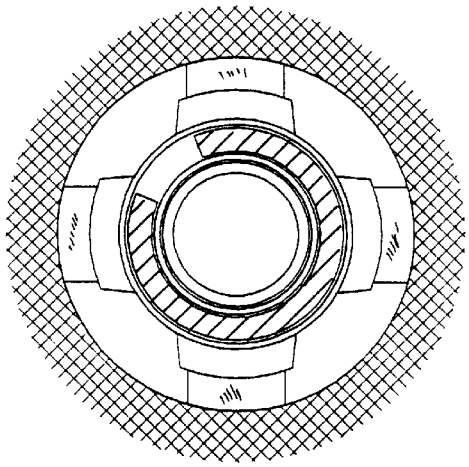

FIG. 2A is a cross-section of the device in the vicinity of barrel 8. The section of the barrel is contained between hollow shaft 1 and body 2. Reference number 14 designates the section of the slot. Ballast 15 orients body 2 and barrel 8, the latter being so oriented that slot 14 is 45° on the left of the vertical. In FIG. 2A, circulation of the drilling fluid is stopped, therefore no pad 3 is spread. It can be noticed that, thus oriented, the barrel covers all the pistons actuating the pads since the slot is situated between two successive pistons. FIG. 2B shows the adjustment of the device arranged as shown in FIG. 2A, but with the drilling rate restored. The four pads are then spread for centering shaft 1 in the borehole. This adjustment of the device is intended for rectilinear drilling.

Figure 2C:
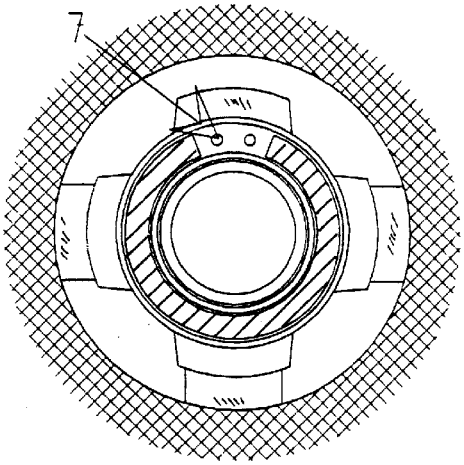
Figure 2D:
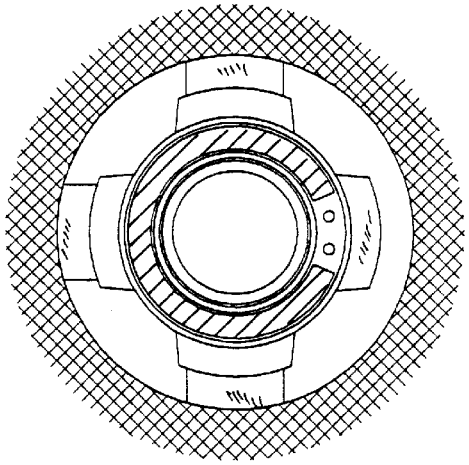
Figure 2E:
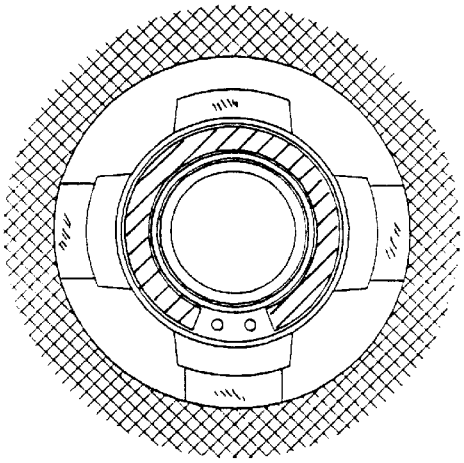
Figure 2F:
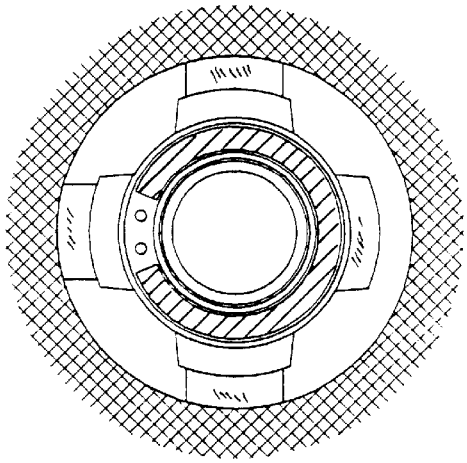

The sections according to FIGS. 2*c*, 2*d*, 2*e* and 2*f* respectively show the other four adjustments: raise drilling, downward drilling, right-hand and left-hand drilling, according to the direction of the retracted pad. In relation to the resting position or to the straight drilling position (FIGS. 2*a* and 2*b*), the barrel takes various positions when rotating in body 2. In FIG. 2*c*, the barrel has performed a 45° rotation to the right so that slot 14 is positioned opposite the pistons actuating the upper pad, which will therefore not be expanded while drilling. In FIG. 2*d*, the barrel has completed a 90° rotation, the right-hand pad will remain retracted while drilling. The other two positions (FIGS. 2*e* and 2*f*) correspond to two successive 90° rotations of the barrel.

Figure 3:
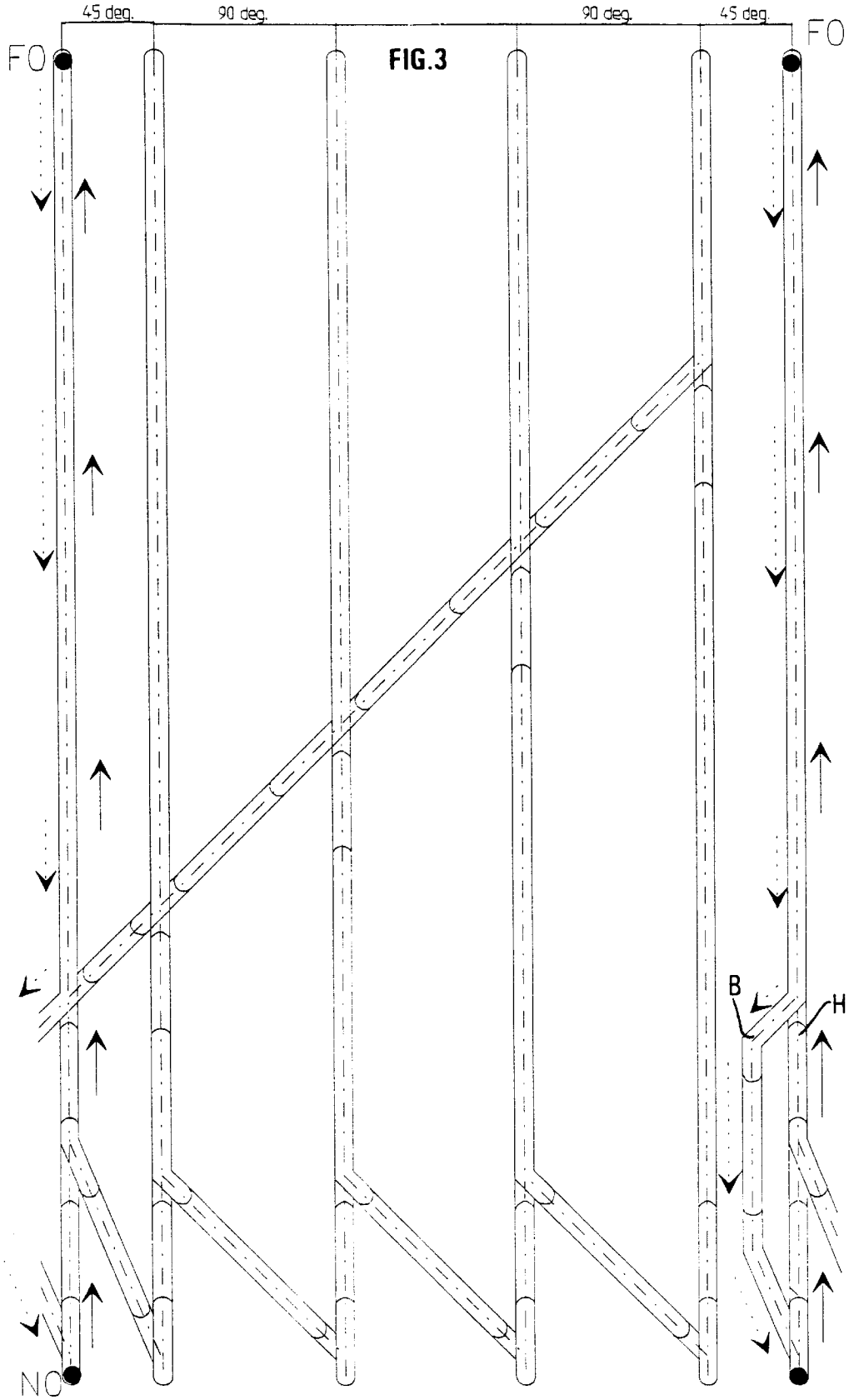
Figure 4:
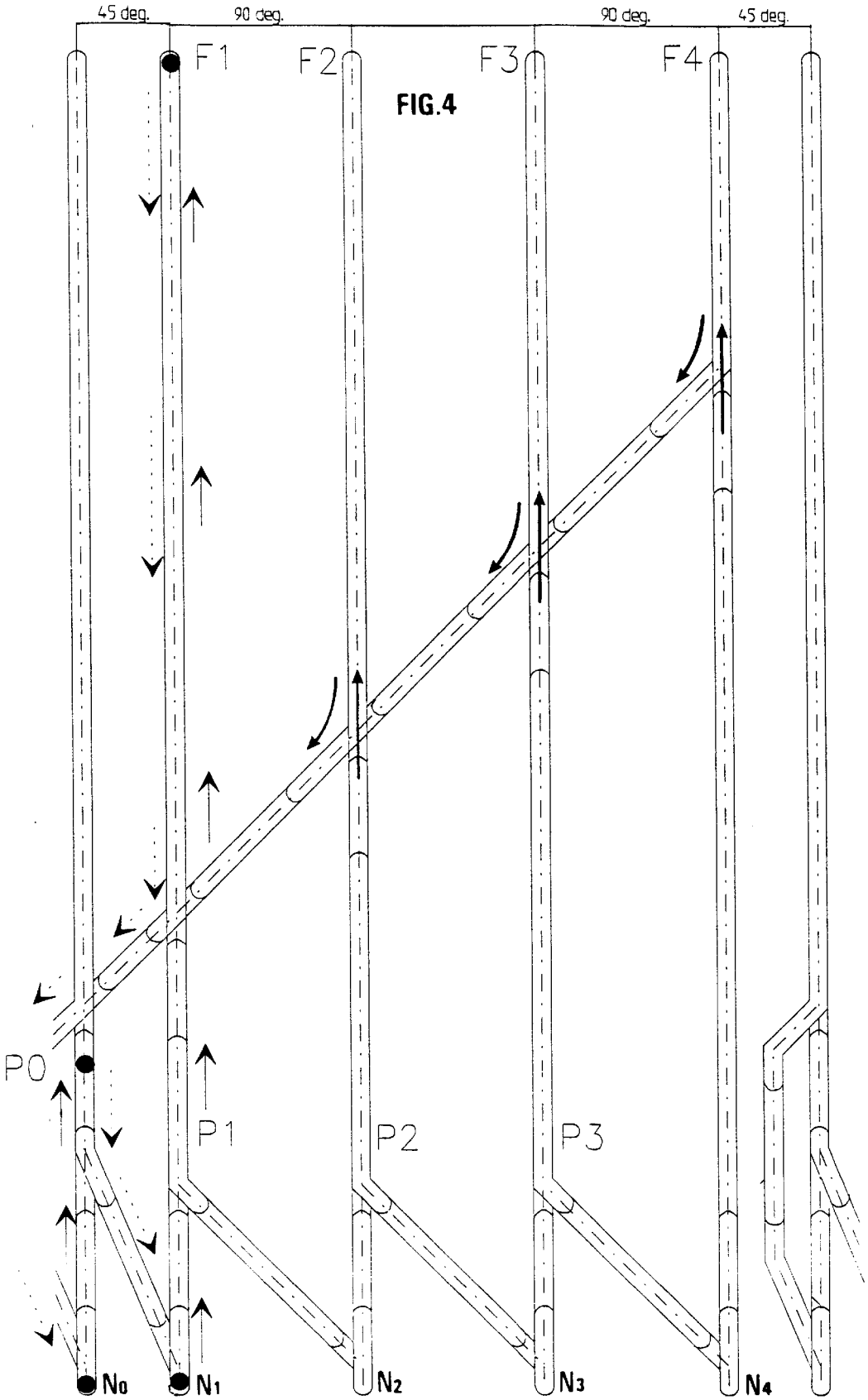

FIGS. 3 and 4 show an embodiment of the means for adjusting the barrel in the body. Of course, this embodiment described by way of example is not the only one allowing implementation of the invention. In fact, sufficient energy can be available to equip the barrel with a (hydraulic or electric) motor in order to rotate it. The adjustment rotations can be controlled from the surface, for example by means of MWD devices known in the trade.

Still in the case of an embodiment with four pads, the pattern of the developed view of the grooves on the barrel (FIGS. 3 and 4) allows the following procedures.

1—Centering without deviation: when circulation is stopped (in order to add on a new length of pipe for example), spring finger 16 is in position N0. Restarting circulation of the drilling fluid to the nominal flow rate without any other operation brings the finger into position F0 where the four pads are spread. Application of the weight on bit and rotation of the pipes then allows to drill without deviating, the pads preventing rotation of body 2 in the well thanks to the frictional resistance on the wall of the well. Circulation stoppage brings the finger back to position N0 via the arrowed route. Groove B is deeper than groove H, so that the finger has to follow the arrowed course on its return travel and not the outward course from N0 to F0. This indexing technique is well-known to the man skilled in the art.

2—Upward deviation: fluid circulation and rotation of the pipes being stopped, the finger is in position N0. Pads 3 being retracted, ballast 15 positions tubular body 2 in relation to the vertical. A partial drilling fluid flow rate creates a force on piston 9 that causes partial displacement of the barrel and brings the finger into position P0. Circulation stoppage causes return of the barrel through the return means and, by the interplay of the various groove depths, the finger is forced into position N1 where the barrel has completed a 45° rotation (according to FIG. 2*c*). Starting circulation of the drilling fluid to the nominal flow rate brings the finger into position F1 where only the three lower pads are spread. The resultant of the stresses, or of the reactions on the wall, exerted by the pads, is directed upwards. Tubular shell 2 being blocked in rotation by the contacts of the pads on the wall, orientation of the resultant of the forces exerted by the pads is maintained. Application of the weight on bit and rotation of the pipes allow to drill by deviating upwards, until the next circulation stop that will bring the finger back to position N0 via the arrowed path.

3—Right-hand, downward or left-hand deviation: they are obtained by repetition of the partial flow rates, followed by stops towards N2, N3 and N4 respectively. It can be noted that the barrel will then complete 90° rotation increments.

It is important to note that any fluid circulation stop after reaching the nominal flow rate will systematically bring finger 16 back to position N0 in the grooves of the barrel, thanks to the interplay of the groove depths and angles. The various adjustments are thus obtained by successive partial flow rate sequences, four to reach N4, three for N3, two for N2 and one for N1.

It is clear that the present device is not limited to four positions.

It is likely that the drilling rate will be facilitated by the presence, on the pads, of rolling devices such as rollers or wheels limiting longitudinal friction while slowing rotation of body 2 down.

The device is not limited to four pads; the present invention can clearly be applied to a device with one, two, three pads, or more than four.

The device thus described will be advantageously used in addition to a deviation measuring while drilling (MWD) device, which will allow the operator to decide on the time and on the length of a trajectory correction and also to check the efficiency thereof.

What is claimed is:

1. A device for controlling trajectory direction of a wellbore, comprising:

a shaft driven in rotation, a drill bit secured to the shaft, a substantially cylindrical body coaxial with the shaft and freely rotatable in relation to the shaft, at least one pad carried by the substantially cylindrical body with each pad being movable radially to engage the wellbore, a system which provides selective radial deployment of individual pads to move radially outward to engage the well bore including a drilling fluid hydraulically activated thruster associated with each pad which, in response to longitudinal displacement thereof in relation to an axis of the device, causes the radial deployment of the associated pad in response to hydraulic energy supplied from drilling fluid circulating in the shaft.

2. A device as claimed in claim 1, wherein the body comprises:

ballast which orients the substantially cylindrical body.

3. A device as claimed in claim 2, wherein:

the ballast is fastened along a generatrix of the substantially cylindrical body.

4. A device as claimed in claim 1 further comprising:

a piston moving longitudinally in the substantially cylindrical body which longitudinally moves each thruster under an effect of the differential pressure between an inner space of the shaft and an inside of the well.

5. A device as claimed in claim 2 further comprising:

a piston moving longitudinally in the substantially cylindrical body which longitudinally moves each thruster under an effect of the differential pressure between an inner space of the shaft and an inside of the well.

6. A device as claimed in claim 3 further comprising:

a piston moving longitudinally in the substantially cylindrical body which longitudinally moves each thruster under an effect of the differential pressure between an inner space of the shaft and an inside of the well.

7. A device as claimed in claim 4, wherein:

the piston longitudinally displaces a cylindrical part comprising a slot extending in a direction of a generatrix of the cylindrical part, the slot having a width and length corresponding to the shape of each thruster.

8. A device as claimed in claim 5, wherein:

the piston longitudinally displaces a cylindrical part comprising a slot extending in a direction of a generatrix of the cylindrical part, the slot having a width and length corresponding to the shape of each thruster.

9. A device as claimed in claim 6, wherein:

the piston longitudinally displaces a cylindrical part comprising a slot extending in a direction of a generatrix of the cylindrical part, the slot having a width and length corresponding to the shape of each thruster.

10. A device as claimed in claim 7, wherein:

the slot is oriented in relation to the well dependent upon orientation of the substantially cylindrical body.

11. A device as claimed in claim 8, wherein:

the slot is oriented in relation to the well dependent upon orientation of the substantially cylindrical body.

12. A device as claimed in claim 9, wherein:

the slot is oriented in relation to the well dependent upon orientation of the substantially cylindrical body.

13. A device as claimed in claim 1, wherein:

the system comprises a series of grooves and at least one finger connected to the substantially cylindrical body.

14. A device as claimed in claim 2, wherein:

the system comprises a series of grooves and at least one finger connected to the substantially cylindrical body.

15. A device as claimed in claim 3, wherein:

the system comprises a series of grooves and at least one finger connected to the substantially cylindrical body.

16. A device as claimed in claim 4, wherein:

the system comprises a series of grooves and at least one finger connected to the substantially cylindrical body.

17. A device as claimed in claim 5, wherein:

the system comprises a series of grooves and at least one finger connected to the substantially cylindrical body.

18. A device as claimed in claim 6, wherein:

the system comprises a series of grooves and at least one finger connected to the substantially cylindrical body.

19. A device as claimed in claim 7, wherein:

the system comprises a series of grooves and at least one finger connected to the substantially cylindrical body.

20. A device as claimed in claim 8, wherein:

the system comprises a series of grooves and at least one finger connected to the substantially cylindrical body.

21. A device as claimed in claim 9, wherein:

the system comprises a series of grooves and at least one finger connected to the substantially cylindrical body.

22. A device as claimed in claim 10, wherein:

the system comprises a series of grooves and at least one finger connected to the substantially cylindrical body.

23. A device as claimed in claim 11, wherein:

the system comprises a series of grooves and at least one finger connected to the substantially cylindrical body.

24. A device as claimed in claim 12, wherein:

the system comprises a series of grooves and at least one finger connected to the substantially cylindrical body.

25. A device as claimed in claim 13, wherein:

the series of grooves is carried by the substantially cylindrical body, the slot being oriented in relation to the substantially cylindrical body by cooperation of the at least one finger and the series of grooves.

26. A device as claimed in claim 25, wherein:

when drilling stops, the series of grooves causes the substantially cylindrical part to always take a same position in relation to the substantially cylindrical body.

27. A method for controlling the trajectory of a wellbore, using the device as claimed in claim 1 which is placed at an end of a drillpipe comprising:

rotating the drill bit by rotation of the shaft and injecting drilling fluid at flow rate Df into the drillpipe, varying a circulation between a zero flow rate and a flow rate Da lower than Df, which orients the cylindrical part in the substantially cylindrical body and actuating at least one pad to move outward radially when the flow rate is Df.

28. A method as claimed in claim 27, wherein:

the trajectory direction is measured and an orientation of the cylindrical part is modified when trajectory direction is not correct.

* * * * *